United States Patent [19]

Packard

[11] 4,090,385

[45] May 23, 1978

[54] MATERIAL TREATING APPARATUS

[75] Inventor: Thomas D. Packard, Stoughton, Mass.

[73] Assignee: Bird Machine Company, Inc., South Walpole, Mass.

[21] Appl. No.: 762,652

[22] Filed: Jan. 26, 1977

[51] Int. Cl.[2] ..... B21D 33/00

[52] U.S. Cl. ..... 72/191; 162/282; 425/374

[58] Field of Search ..... 72/190, 191, 168, 166; 162/281, 282; 15/256.15; 264/282, 283; 93/1 WZ; 425/374; 113/116 Y, 116 Z

[56] References Cited

U.S. PATENT DOCUMENTS

| | | | |
|---|---|---|---|
| 797,716 | 8/1905 | Brenzinger | 72/168 |
| 1,676,655 | 7/1928 | Lorenz | 162/282 |
| 1,764,676 | 6/1930 | Campbell | 162/281 |
| 3,416,192 | 12/1968 | Packard | 425/374 |

*Primary Examiner*—Lowell A. Larson
*Attorney, Agent, or Firm*—Edgar H. Kent

[57] ABSTRACT

Apparatus for treating lengthwise traveling material has a material driving member provided with alternating grooves and lands extending parallel to the direction of drive of the material, presser means to press the material against the lands, and a retarder member downstream of the presser member for deflecting the material away from the driving member, the retarder member having an edge portion extending across the path of travel of the material provided with teeth extending into the driving member grooves with clearance from the groove walls, and intervening slots receiving therethrough the lands of the driving member with clearance from the slot walls. The construction avoids snagging of the material by, or diving of the material under, the retarding member, and wear of the retarder member.

12 Claims, 4 Drawing Figures

FIG 2
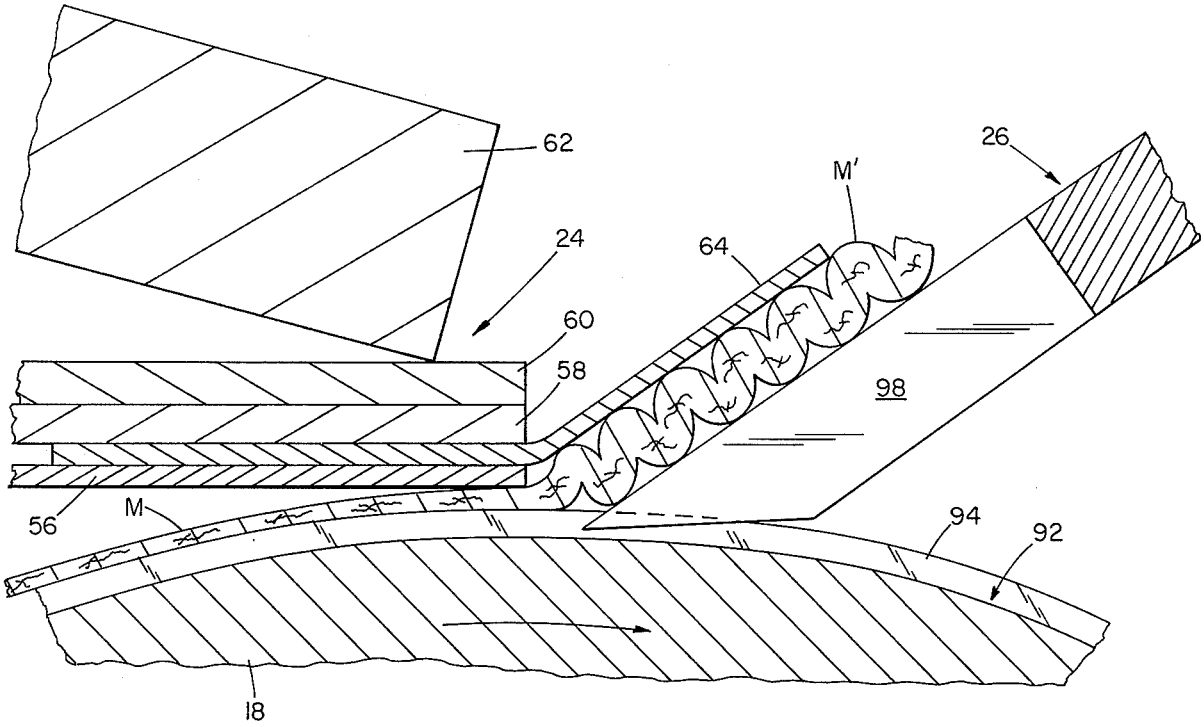
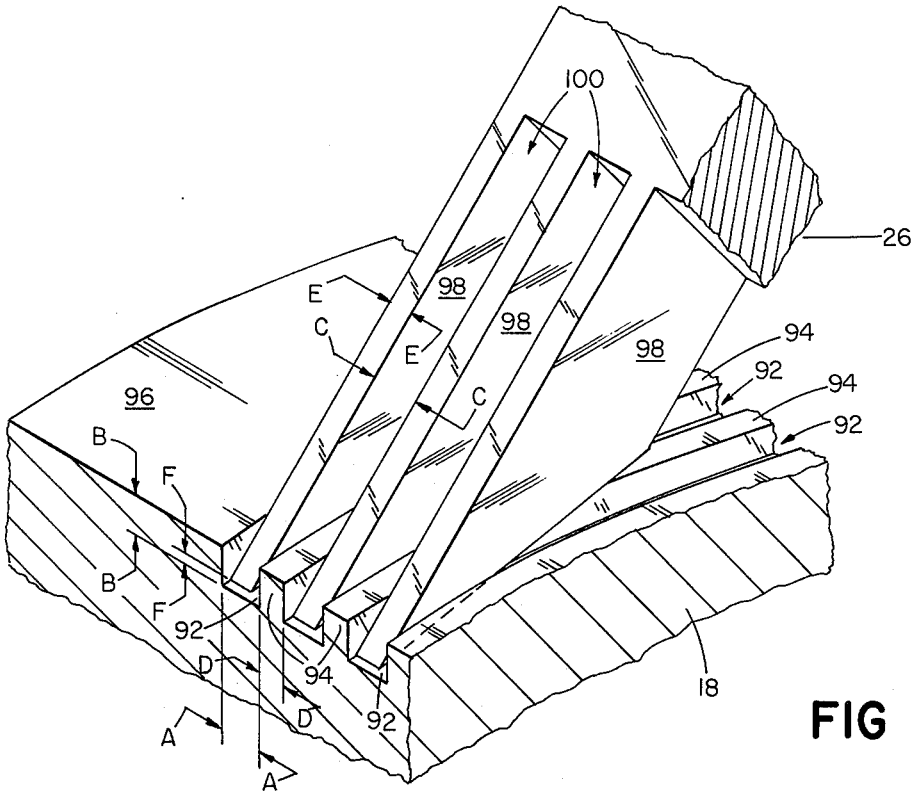
FIG 4

MATERIAL TREATING APPARATUS

BACKGROUND OF THE INVENTION

1. Field of the Invention

This invention relates to apparatus for treating lengthwise traveling material, particularly such apparatus for creping, microcreping or compacting a flexible web material, such as paper, textile, metal foil or plastic.

2. Description of the Prior Art

In one type of creping apparatus of the prior art, the material is adhered to a traveling driving surface such as that of a rotating drum or roll, and is creped by scraping it off that surface with a doctor blade. The traveling surface may be smooth, in which case a straight edged doctor blade produces a transverse crepe in the material, or the surface may be corrugated, that is, provided with alternating grooves and lands parallel to the direction of travel. In the latter case, means are provided for forcing the material into the grooves and the doctor is provided with teeth engaging in the grooves and intervening slots engaging the lands so that a longitudinal creping of the material is produced, as in U.S. Pat. Nos. 1,447,699 and 1,582,839.

In a different type of creping apparatus of the prior art, the material is not adhered to the traveling surface which is smooth, transverse creping of the material being effected by a combination of retarding and compressive forces exerted on the material during its travel on, and removal from, the driving surface. In this type of apparatus, a doctor blade is also commonly use, not to scrape the material from the driving surface but rather to form a retarding surface against which the traveling material impinges and which deflects the material away from the driving surface, as in U.S. Pat. No. 3,260,778.

This invention relates to apparatus of the second above-mentioned type, as exemplified by aforesaid U.S. Pat. No. 3,260,788 . In such apparatus, although the retarding member does not function as a scraper, it has been found necessary to force the retarder edge into engagement with the driving surface in order to prevent the material from snagging on or "driving" under the edge of the retarding member, with resultant loss of material and processing time. This not only causes undesirable wearing away of the retarding member, but also, due to irregularities and roughness produced by wear, causes snagging and diving of the material to occur. This problem has been so acute as to prevent satisfactory use of such apparatus for processing certain types of materials, such as thin, light webs or those with surface roughness, particularly prone to snagging or diving.

SUMMARY OF THE INVENTION

An object of this invention is to overcome the aforesaid difficulties with prior apparatus of the type concerned by providing a construction in which the retarding member is maintained out of contact with the material driving surface while nevertheless snagging and diving of the material with respect to the member are avoided.

Another object is to provide apparatus embodying such construction which produces desired creping, microcreping or compacting with a minimum of undesirable effects such as longitudinal corrugation or streaking of the material by the retarder member.

In attaining the foregoing objects, there is provided apparatus of the type concerned wherein the driving member for producing lengthwise travel of the material has a material-contacting surface which is provided with a multiplicity of alternating grooves and lands extending parallel to the direction of drive of the material by the driving member. A presser means has a material contacting surface arranged to press the material against the surface of the driving member. A feed means feeds the material into driven engagement with the driving member in advance of the presser means and cooperates with the presser means to maintain sufficient widthwise tension on the material to keep it smooth, so that it engages the lands and bridges the grooves of the driving member. A retarding member, located on the same side of the material as the driving member, retards and deflects the travel of the material away from the driving member as the material passes the presser means, and has an edge extending across the path of travel of the material provided with a multiplicity of alternating teeth and slots. The teeth have their free ends disposed in the grooves in the surface of the driving member with clearance from the walls of the grooves. The slots receive therethrough the lands between the grooves of the driving member with clearance from the walls of the slots.

In preferred embodiments the lands between the grooves of the driving member are of the same height and are flat topped;—i.e., of uniform height between their edges, the driving member is a roll with circular grooves and lands, and the presser means has a continuous smooth surface engaging the material and pressing it against the lands of the surface of the driving member.

The teeth of the retarder member extending into the grooves of the driving member prevent the material from diving under the edge of the retarder member. The edges of the teeth and slots of the retarder member may be made smooth and, since they have no wearing engagement with the driving member, they will remain so. Hence snagging of the material is effectively avoided. Desirably, the widths of the grooves, lands, teeth and slots are quite small, as there is less tendency for the material to indent into and be corrugated or marked by narrow grooves, and narrow slots present so short an exposed end to the material that there is no tendency for a portion of the fabric to dive under it. In preferred embodiments the grooves, lands, teeth and slots have respectively uniform widths which are less than 0.2 inch (5mm).

Where, as in U.S. Pat. No. 3,260,778, a surface means is provided on the opposite side of the material from the retarder member to form therewith a retarding passage through which the material exists, it is preferred to have the slot length extend beyond the area of contact of the material with the surface means. It was found that if the slots terminated between the surfacing means and the retarder member, there was a tendency of the slot ends to snag surface fibers on the material, and to produce marks or streaks on the face of the material contacting the retarder member. Apparently, this was due to the fact that the material was under pressure between the surface means and the retarder member as it passed over the slots ends, since the difficulty was eliminated by extending the slot length beyond the end of such pressure zone, and hence such construction is preferred when the surfacing means is used.

BRIEF DESCRIPTION OF THE DRAWINGS

In the drawings:

FIG. 2 is a vertical cross-section view through that portion of the apparatus shown in FIG. 1 in which microcreping of the material is effected;

FIG. 4 is an enlarged partial vertical section, partial elevation view of part of the apparatus shown in FIG. 3.

DESCRIPTION OF THE PREFERRED EMBODIMENT

Figure 1:
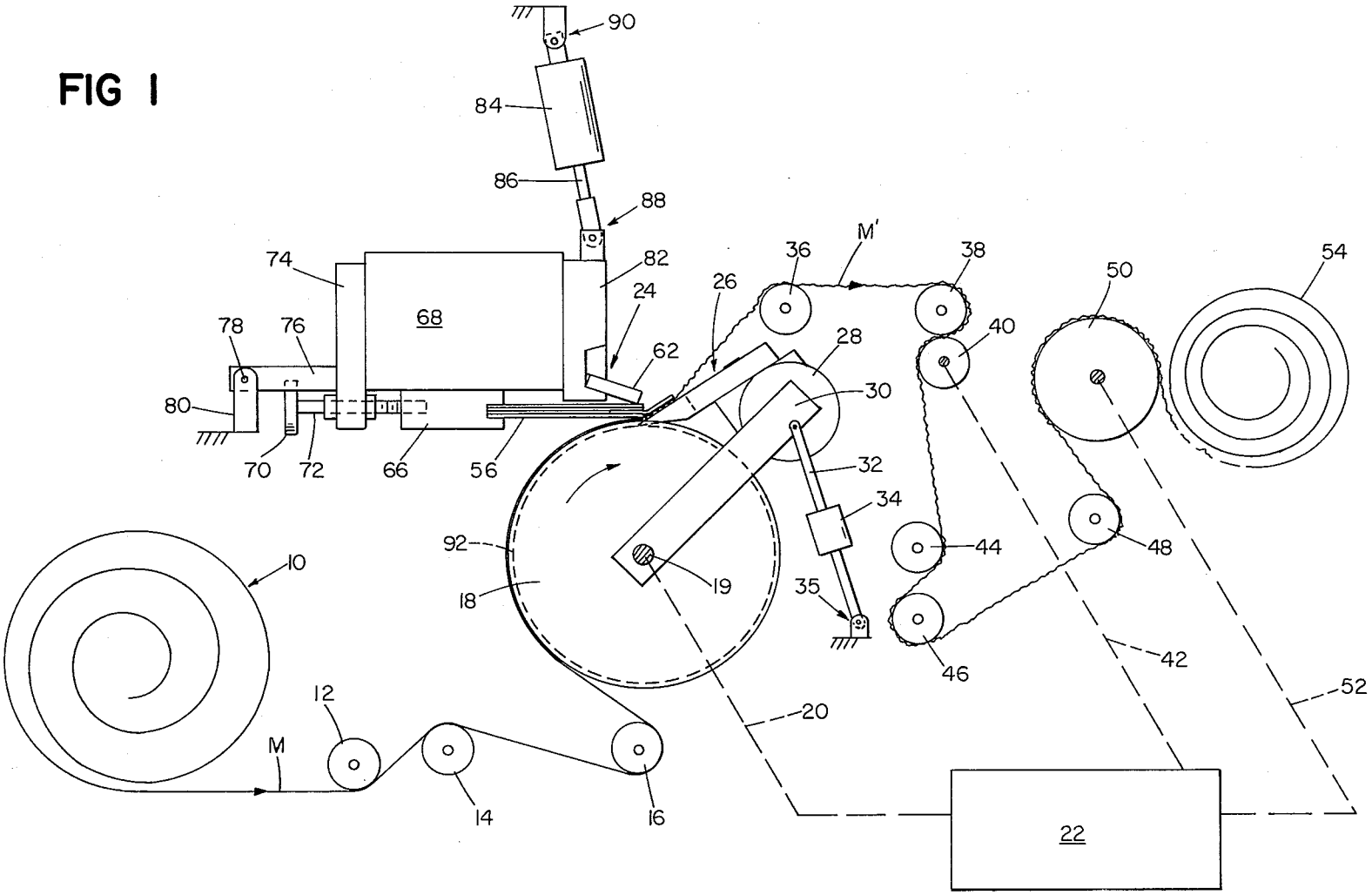
FIG. 1 is a diagrammatic side elevation view of apparatus embodying the invention.

In the preferred embodiment shown in the drawings, the invention is shown utilized in apparatus for microcreping various materials, which is otherwise similar to that of U.S. Pat. No. 3,260,778 aforesaid, wherein the invention may be utilized to particular advantage.

Referring to FIG. 1, the material to be treated M is drawn from a supply roll 10, rotatably mounted on an unwind stand (not shown), under an idler bow roll 12, which tensions it widthwise, over intermediate idler rolls 14 and 16, from the latter of which it is fed to the surface of the driving member, roll 18. Roll 18 is rotated in the direction of the arrow by suitable connection (which may be chain and sprocket), indicated by dash line 20, of its shaft 19 to a drive device indicated by block 22, which draws the material thereto from roll 10 and carries the material partially around its axis into the nip between roll 18 and a presser means designated generally 24, which presses the material toward the driving roll surface at a point close to vertical alignment with the roll axis.

A retarder member, designated generally 26, engages the material as it passes the presser means to retard and divert the material away from the surface of roll 18 at an acute angle. Retarder member 26 is mounted on shaft 28 fixedly mounted to end support arms 30 (one shown) which are mounted for pivotal motion about the axis of roll 18 by adjustment of longitudinally adjustable end support links 32 (one shown) pivoted to arms 30 and having screw threaded ends which are rotated by worm driven jack screws 34 to extend or retract their length beyond jack screws 34, which are pivotally mounted by rod and pivot connection 35 to a fixed support such as a frame part. Jack screws 34 may be operatively connected to a single operating device for uniform adjustment of both links 32, which hold the retarder member support shaft 28 in fixed position once adjusted.

The material microcreped by the combined action of the presser and retarder means and designated M′ is drawn over idler rolls 36 and 38, with suitable lengthwise tension, by roll 40 which is rotated by a suitable drive connection indicated by dash line 42 to drive device 22, passing through the nip between rolls 38 and 40 and being drawn over an idler bow roll 44, which tensions it widthwise and over idler rolls 46 and 48 by winder drum 50. Drum 50 is rotated by suitable drive connections indicated by dash line 52 to drive device 22 and winds the material into a roll 54 on a rewind stand (not shown).

As shown in FIG. 2, the presser means 24 includes a lower presser plate 56 and a pair of upper plates 58 and 60, the forward ends of the plates in the direction of travel of the material being urged toward the drive roll 18 by the nose of a pressure-applying member 62. Preferably, a flexible surface member is provided to engage the face of the material opposite that engaging retarder member 26, and to form with retarder member 26 a passage for the material which converges in the direction of material travel (shown expanded by the material). As shown in FIG. 2, this surface member is in the form of a spring plate 64, having one end sandwiched and held between plates 56 and 58 and the other end, extending beyond these plates so that it overlies an end portion of retarder member 26, bent to form with retarder member 26 the convergent passage above referred to.

Plate 56 extends the full width of the material and has a smooth, continuous material-engaging face which presses the material against the surface of roll 18 uniformly across its width. As the material passes beyond plate 56, its thickness expands and one of its faces is engaged and retarded by retarder member 26, so that the material compacts longitudinally into a fine creped or microcreped condition as shown. Surface member 64, which also extends the full width of the material, assists this action by retarding the opposite surface of the material, thereby providing more resistance to the forward movement of the material as it is driven from under the presser means by the roll 18, and confining the material to increase the frequency and reduce the size of the crepe undulations.

Figure 3:
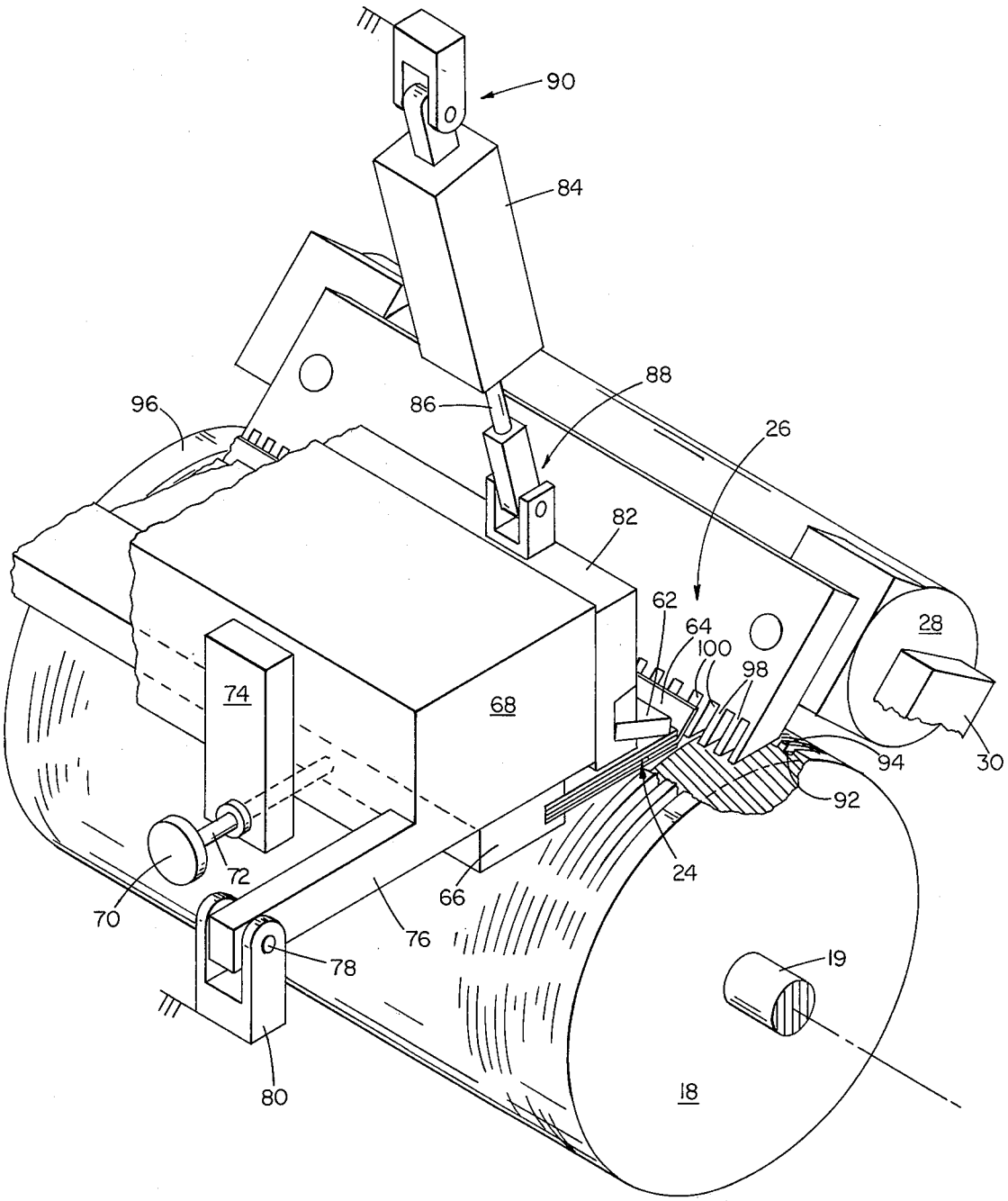
FIG. 3 is an end elevation detail view of the part of the apparatus shown in FIG. 2.

Referring to FIGS. 1 and 3, the assembly of plates 56, 58, 60 and 64 is mounted at one end in a block 66 which is mounted to slide generally parallel to the axis of roll 18 in the underside of a support head 68. An adjustment knob 70 for effecting sliding adjustment of block 66 to a desired position of the forward end of the pressure plate assembly relative to the axis of roll 18, has a stem 72 extending rotatably through an arm 74 attached to head 68 with a threaded end received in a threaded bore in block 66. Head 68 is mounted for adjustment to move the pressure plate assembly toward and away from roll 18 by means of arms 76 projecting rearwardly from the ends thereof and pivotally mounted at their rearward ends on pins 78 in yokes 80 fixed to a stationary support such as a frame part.

Pressure-applying member 62 is fixedly mounted at one end in a shoe 82, extending at a downward angle therefrom such that its under forward edge has substantially line contact with plate 60. Shoe 82 is mounted to slide on the forward end of head 68, generally toward and away from the axis of roll 18, to adjust the pressure applied thereby through plates 60 and 58 to presser plate 56. Such sliding adjustment of shoe 82 is effected by a push-pull fluid pressure cylinder 84, the piston rod 86 of which is connected to shoe 82 by a pin and yoke pivot connection 88, the opposite end of the cylinder 84 being connected to fixed structure, such as a frame part, by a pin and yoke pivot connection 90.

The apparatus as so far described is in accordance with U.S. Pat. No. 3,260,778 aforesaid, and is only a preferred example of apparatus which can be advantageously modified in accordance with the present invention. It may therefor be departed from in various respects as will be understood.

Describing now the modifications according to the present invention, as best seen in FIG. 4, the material-contacting surface of drive roll 18 is provided with a multiplicity of grooves 92 and intervening lands 94 which are circular about the axis of roll 18 and therefore parallel to the direction of travel of the material. These grooves and lands are provided substantially throughout the area which underlies the material, being omitted in end portions only of the roll, such as end portion 96 shown in FIG. 4, most of which extend beyond the side edges of the material. Retarder member 26 is in the form of a rigid strip of material, such as metal, having its edge close to the downstream end of presser plate 56, which extends the full width of the material, provided with a multiplicity of teeth 98 and intervening slots 100, corresponding respectively in position to the grooves 92 and lands 94 in the roll 18.

Teeth 98 of the retarder are narrower than grooves 92 and the retarder member mounting is adjusted so that the teeth 98 are centered on the grooves 92 with their tips projecting into the grooves 92, so that clearance is provided between the teeth 98 and the bottoms and side walls of the grooves. As shown, the teeth 98 may advantageously be cut away on their under surface so that only their tips extend into grooves 92. Slots 100 are elongated beyond the downstream end of the surface member 64 which they underlie, for reasons previously set forth.

The lands 94 should be of the same height and desirably are of uniform height between their side edges, as shown. Desirably also, the tops of the lands 94 and the materialcontacting surface of the teeth 98 are smooth, although surface roughness may be provided on either or both to assist their respective drive and retarding functions. While dimensions are not critical, it is preferred that the grooves 92 and slots 100 be narrow and frequent, as this reduces the areas of the material lying between those supported by lands or teeth, such unsupported areas, if too large, having a potential for undesirably responding differently than the supported areas to the creping action of the apparatus, and narrow slots offer low opportunity for the material to indent between the teeth and catch on or dive under the slot ends. In the preferred embodiment the dimensions, indicated between lettered arrows in FIG. 4, are approximately: Width A—A of grooves 92, 0.08 inch (2mm) and their depth B—B, 0.10 inch (2.5mm); width C—C of slots 100, 0.10 inch (2.5mm); width D—D of lands 94, 0.07 inch (1.8mm); width E—E of teeth 98, 0.05 inch (1.3mm); clearance F—F of teeth 98 from bottoms of grooves 92, 0.015 inch (0.4mm), and the same from the sides.

In operation it has been found that the grooves of the drive member surface and the slots of the retarder member do not, in most instances, longitudinally corrugate or streak the material, or otherwise impair the uniformity of treatment of the material by the apparatus, yet the construction overcomes the problem of snagging and diving of the material, which has hampered the use of apparatus of the prior art. The lateral tensioning of the material by the bow roll 12 in the material feed line to drive roll 18 assists in maintaining a smooth lay of the material on the lands of the drive roll 18, particularly with soft, supple materials. With laterally stiffer materials the bow roll may not be needed, controlled longitudinal tension on the material between the roll 16 and the presser means being often sufficient to keep the material essentially flat.

I claim:

1. Apparatus for treating lengthwise traveling material comprising a driving member, the material-contacting surface of said driving member being provided with a multiplicity of alternating grooves and lands extending parallel to the direction of drive of the material by the driving member, presser means to press said material against said surface of said driving member, feed means arranged to feed the material into driven engagement with said face of said driving member in advance of said presser means and cooperating with said presser means to maintain sufficient widthwise tension on the material to keep it smooth, so that it engages the lands and bridges the grooves of said surface of said driving member, and a retarding member for deflecting the material away from said driving member, located on the same side of the material as said driving member, said retarder member comprising a multiplicity of alternating teeth and slots, said teeth extending into said grooves of said driving member from fixed ends located beyond said presser means in the direction of drive of the material and having their free ends disposed in said grooves of said driving member surface with clearance from the walls of said grooves, said slots receiving therethrough the lands of said driving member surface with clearance from the walls of said slots.

2. Apparatus according to claim 1 wherein said grooves, lands, teeth and slots are respectively of substantially the same widths.

3. Apparatus according to claim 2 wherein said widths are less than 0.2 inch.

4. Apparatus according to claim 3 wherein the widths of said grooves, lands, teeth and slots at their outer ends are in inches approximately: grooves 0.08, lands 0.07, teeth 0.05 and slots 0.10.

5. Apparatus according to claim 1 wherein the clearance of said teeth from the walls of said grooves is approximately 0.015 inch.

6. Apparatus according to claim 1 wherein said lands are of approximately the same height throughout their widths.

7. Apparatus according to claim 1 wherein said driving member is a rotated roll and said grooves and lands are circular.

8. Apparatus according to claim 1 which further includes a surface means extending over both said driving member and said retarding member in the region where the material moves from said driving member to said retarding member, said surface means arranged to slippably contact said material during its passage through said region.

9. Apparatus according to claim 8 wherein said teeth and slots extend beyond the region of contact of said surface means with said material in the direction of travel of the material.

10. Apparatus according to claim 9 wherein said surface means and driving member define a passage which diverges to said retarding member and said surface means and retarding member define a retarding passage that converges forwardly in the direction of travel of the material.

11. Apparatus according to claim 1 wherein said presser means has a continuous, smooth surface for engaging the material and pressing it against the surface of the driving means.

12. Apparatus according to claim 1 wherein said retarding member is arranged to deflect the material from the driving member at an acute angle to the surface thereof at the point of deflection.

* * * * *